US009704699B2

(12) United States Patent
Satake et al.

(10) Patent No.: US 9,704,699 B2
(45) Date of Patent: Jul. 11, 2017

(54) HYBRID ION SOURCE AND MASS SPECTROMETRIC DEVICE

(71) Applicant: Hitachi High-Technologies Corporation, Minato-ku, Tokyo (JP)

(72) Inventors: Hiroyuki Satake, Tokyo (JP); Hideki Hasegawa, Tokyo (JP); Yukiko Hirabayashi, Tokyo (JP); Yuichiro Hashimoto, Tokyo (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

(21) Appl. No.: 14/911,411

(22) PCT Filed: Jul. 9, 2014

(86) PCT No.: PCT/JP2014/068272
§ 371 (c)(1),
(2) Date: Feb. 10, 2016

(87) PCT Pub. No.: WO2015/033663
PCT Pub. Date: Mar. 12, 2015

(65) Prior Publication Data

US 2016/0196965 A1 Jul. 7, 2016

(30) Foreign Application Priority Data

Sep. 5, 2013 (JP) ..... 2013-184177

(51) Int. Cl.
*H01J 49/00* (2006.01)
*H01J 49/10* (2006.01)
(Continued)

(52) U.S. Cl.
CPC ..... *H01J 49/107* (2013.01); *H01J 49/0468* (2013.01); *H01J 49/165* (2013.01); *H01J 49/168* (2013.01)

(58) Field of Classification Search
None
See application file for complete search history.

(56) References Cited

U.S. PATENT DOCUMENTS 6,759,650 B2 * 7/2004 Covey ..... H01J 49/165 250/282
7,488,953 B2 * 2/2009 Fischer ..... H01J 49/0445 250/281
(Continued)

FOREIGN PATENT DOCUMENTS

JP 8-236064 A 9/1996
JP 08236064 A * 9/1996
(Continued)

OTHER PUBLICATIONS

International Search Report (PCT/ISA/210) issued in PCT application No. PCT/JP2014/068272 dated Aug. 5, 2014 with English translation (Two (2) pages).
(Continued)

*Primary Examiner* — Andrew Smyth
(74) *Attorney, Agent, or Firm* — Crowell & Moring LLP

(57) ABSTRACT

In order to provide an ion source that can be easily switched with high sensitivity and in a short time, the ion source includes an ionization probe for spraying a sample, a heating chamber for heating and vaporizing a sample; and driving portions and for changing the distance between an outlet end (i.e., an end on the spray side) of the ionization probe and an inlet end (i.e., an end on the ionization probe side) of the heating chamber. The positions of the ionization probe and the heating chamber are controlled by the driving portions so that an ionization region that uses the ionization probe or an ionization region that uses the heating chamber is positioned near the ion inlet port of the mass spectrometer.

13 Claims, 17 Drawing Sheets

(51) Int. Cl.
*H01J 49/04* (2006.01)
*H01J 49/16* (2006.01)

(56) References Cited

U.S. PATENT DOCUMENTS

| | | | | |
|---|---|---|---|---|
| 2006/0169887 | A1* | 8/2006 | Yamaguchi | H01J 49/165<br>250/288 |
| 2009/0236518 | A1* | 9/2009 | Kobayashi | G01N 30/726<br>250/288 |
| 2009/0250608 | A1* | 10/2009 | Mordehai | H01J 49/167<br>250/288 |
| 2012/0104248 | A1* | 5/2012 | Hardman | H01J 49/165<br>250/288 |
| 2014/0131570 | A1* | 5/2014 | Yoshioka | G01N 30/7266<br>250/288 |

FOREIGN PATENT DOCUMENTS

| | | | | | |
|---|---|---|---|---|---|
| JP | 2004-139962 | A | | 5/2004 | |
| JP | 2004139962 | A | * | 5/2004 | H01J 49/165 |
| JP | GB 2394830 | A | * | 5/2004 | H01J 49/165 |
| JP | 2004185886 | A | * | 7/2004 | H01J 49/107 |
| JP | GB 2394830 | B | * | 8/2005 | H01J 49/165 |
| JP | 4553011 | B2 | * | 9/2010 | G01N 30/726 |

OTHER PUBLICATIONS

Japanese-language Written Opinion (PCT/ISA/237) issued in PCT application No. PCT/JP2014/068272 dated Aug. 5, 2014 (Three (3) pages).

* cited by examiner

HYBRID ION SOURCE AND MASS SPECTROMETRIC DEVICE

TECHNICAL FIELD

The present invention relates to an ion source device for generating ions from a sample and a mass spectrometer using the ion source device.

BACKGROUND ART

An atmospheric pressure ionization mass spectrometer analyzes the mass of ions by introducing ions generated at atmospheric pressure into a vacuum system. Among atmospheric pressure ionization methods that are widely used are electrospray ionization (ESI) and atmospheric pressure chemical ionization (APCI).

In ESI, a sample solution is flowed through a sample spray nozzle (i.e., capillary) to which a high voltage is applied, so as to be sprayed and form charged droplets, and then, the charged droplets repeatedly undergo evaporation and fission to generate ions. In ESI, a method is also used that includes coaxially arranging a nebulizer gas nozzle around the outer circumference of the sample spray nozzle so that finer charged droplets are sprayed with blowing of nebulizer gas. When the liquid flow rate is high, in particular, a method of spraying a large amount of heated gas (i.e., heating gas) to promote evaporation and vaporization of the droplets is also used in combination. ESI is an ionization method that can be applied to a high-molecular-weight sample with a high molecular weight, a highly polar sample with high polarity, and the like.

APCI is a method of ionizing sample molecules, which have been obtained by heating and vaporizing a sample solution, using corona discharge. In this method, electric charges move between the sample molecules and the primary ions generated by the corona discharge so that the sample molecules are ionized. APCI can be applied to even a low-molecular-weight sample with a lower molecular weight than that in ESI or a low polarity sample with lower polarity than that in ESI.

Therefore, it is necessary to selectively use the ionization methods depending on samples to be analyzed. For such reasons, if a plurality of ionization methods (i.e., ESI and APCI) that are based on different ionization principles can be implemented using a single ion source, it becomes possible to expand the range of substances to be measured.

Patent Literature 1 describes a method of switching between two ionization methods, specifically, a method of switching an ionization method from ESI to APCI or vice versa by manually switching a probe from an ESI probe to an APCI probe or vice versa.

Patent Literature 2 and Patent Literature 3 each propose a method of executing ESI and APCI using an ion source with the same configuration without switching a probe or the like. An electrostatic spray portion of ESI and a needle electrode of APCI are arranged in the same space, and ESI ionization and APCI ionization are executed concurrently.

Patent Literature 4 describes a configuration in which an atomization chamber that is movable in the axial direction of an ionization probe (i.e., needle) is provided, and an ionization method is switched by moving the atomization chamber between ESI and APCI. The needle and the atomization chamber are moved by a movement mechanism so that an end of the needle is arranged such that it protrudes forward beyond the atomization chamber in ESI and is arranged within the atomization chamber in APCI. With this method, the ionization method can be easily switched in a short time.

CITATION LIST

Patent Literature

Patent Literature 1: U.S. Pat. No. 6,759,650 B2
Patent Literature 2: JP 4553011 B2
Patent Literature 3: U.S. Pat. No. 7,488,953 B2
Patent Literature 4: JP H08-236064 A

SUMMARY OF INVENTION

Technical Problem

In Patent Literature 1, switching an ionization method takes time and involves complex operations as a probe is manually switched from an ESI ionization probe to an APCI ionization probe or vice versa. In addition, as an operation of turning on or off a heater is needed, it takes tens of minutes to stabilize the temperature by increasing or lowering the temperature.

In the examples described in Patent Literature 2 and Patent Literature 3, ESI ionization and APCI ionization are performed concurrently. Thus, it is, in principle, possible to measure ions that have been generated by either method. However, as the two types of ionization are performed concurrently, a problem occurs in that sensitivity decreases.

In Patent Literature 4, a heater of the atomization chamber should be turned on or off when an ionization method is switched. Thus, there is a problem in that a waiting time is generated. That is, as the heater is turned off in ESI and is turned on in APCI, it is predicted that at least several minutes to tens of minutes would be required to stabilize the temperature of the heater. Thus, a high throughput analysis is difficult to perform.

Herein, suppose a case where the heater of the atomization chamber is always set off or on regardless of the ionization methods in Patent Literature 4. In such a case, as a waiting time for stabilizing the temperature is not needed, the ionization method can be switched at fast speed. However, the following problems are concerned. If the heater is always off, it is predicted that an operation is performed without any problem in ESI; however, if the heater is off in APCI, there will be almost no vaporization effect in the atomization chamber. Thus, it is predicted that a significant decrease in the sensitivity occurs. Next, if the heater is always on, the atomization chamber is heated in ESI. Thus, a liquid sample undergoes bumping (i.e., boiling) and electrospray does not go well. Thus, problems occur in that sensitivity decreases, or ionization becomes unstable and ionization intensity fluctuates.

As described above, the conventional techniques have problems in that sensitivity decreases or switching of ionization takes a long time.

The present invention provides a hybrid ion source with high sensitivity that can easily switch between a plurality of ionization methods in a short time, and a mass spectrometric device that uses the ion source.

Solution to Problem

An ion source of the present invention includes an ionization probe for spraying a sample; a heating chamber having an internal sample flow path, the heating chamber being adapted to heat and vaporize a sample that flows through the sample flow path; and a driving portion for changing a distance between an outlet end of the ionization probe and an inlet end of the heating chamber. The distance between the ionization probe and the heating chamber is changed by the driving portion to individually execute a plurality of ionization methods.

The plurality of ionization methods include ESI and APCI or include ESI and APPI.

The driving portion may drive at least one of the ionization probe or the heating chamber either linearly or by rotating it about a fixed point.

A mass spectrometric device of the present invention includes an ion source adapted to ionize a sample; a mass spectrometer having an ion inlet port into which sample ions obtained through ionization by the ion source are introduced, the mass spectrometer being adapted to analyze a mass of the ions introduced from the ion inlet port; and a control unit. The ion source includes an ionization probe for spraying a sample, a heating chamber having an internal sample flow path, the heating chamber being adapted to heat and vaporize a sample that flows through the sample flow path, and a driving portion for changing a distance between an outlet end of the ionization probe and an inlet end of the heating chamber. The driving portion is controlled by the control unit to change a position relationship of the ionization probe and/or the heating chamber with respect to the ion inlet port of the mass spectrometer, thereby individually executing a plurality of ionization methods.

The control unit is adapted to control the driving portion so that a sample ionization region of an ionization method that uses the ionization probe, or a sample ionization region of an ionization method that uses the ionization probe and the heating chamber are positioned near the ion inlet port of the mass spectrometer.

As specific examples, the plurality of ionization methods include ESI and APCI or include ESI and APPI. The control unit is adapted to, in the ESI mode, control the driving portion so that the heating chamber is not arranged between the outlet end of the ionization probe and the ion inlet port of the mass spectrometer, and to, in the APCI mode or the APPI mode, control the driving portion so that the heating chamber is arranged between the outlet end of the ionization probe and the ion inlet port of the mass spectrometer.

Advantageous Effects of Invention

According to the present invention, it is possible to always maintain the temperature constant without the need to wait until the temperature of a heater becomes stable when an ionization method is switched. Thus, an ionization method can be switched at fast speed in a short time. In addition, as each ionization method can be performed under optimal conditions, a high-sensitivity analysis is possible.

Other problems, configurations, and advantageous effects will become apparent from the following description of embodiments.

DESCRIPTION OF EMBODIMENTS

Hereinafter, embodiments of the present invention will be described with reference to the drawings.

The present invention is directed to switching between two ionization methods such as ESI and APCI, and switching between the two ionization methods at fast speed by coupling or separating an ionization probe and a heating chamber to/from each other by moving them relative to each other. Although the drawings show specific embodiments in accordance with the principle of the present invention, such drawings should be used only for the understanding of the present invention, and should not be used to narrowly construe the present invention.

First Embodiment

Figure 1:
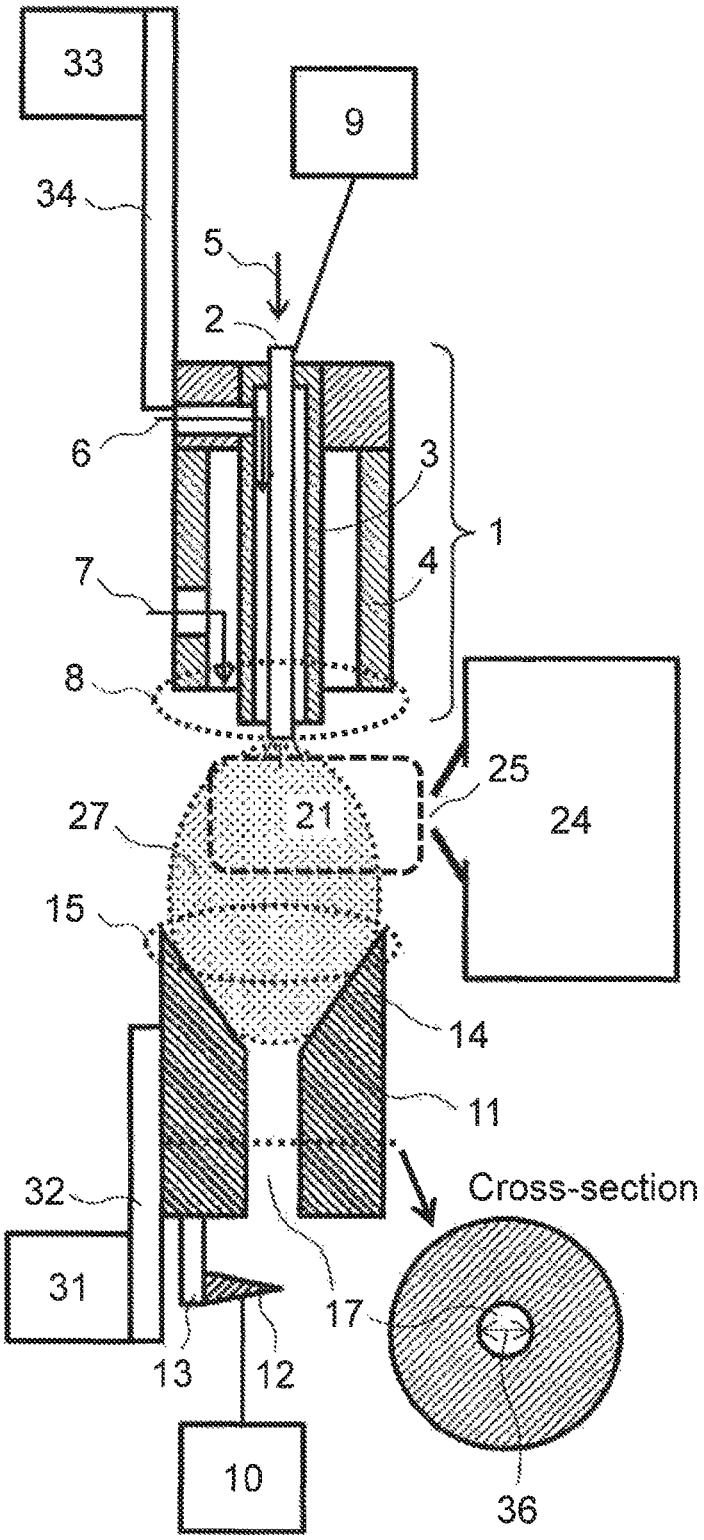
FIG. 1 is a schematic cross-sectional view showing an exemplary configuration (ESI mode) of an ion source in the first embodiment.
Figure 2:
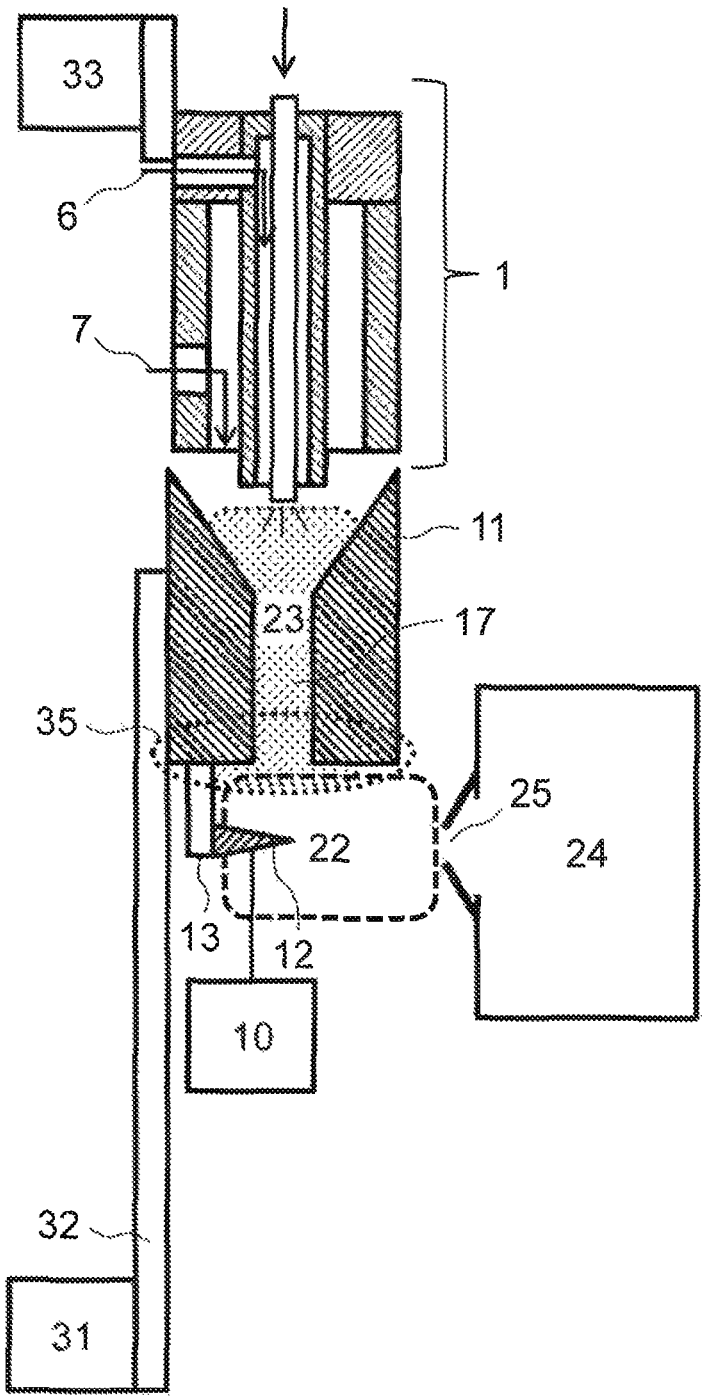
FIG. 2 is a schematic cross-sectional view showing an exemplary configuration (APCI mode) of an ion source in the first embodiment.

FIGS. 1 and 2 are schematic cross-sectional views each showing exemplary configurations of a mass spectrometric device and an ion source in accordance with the first embodiment of the present invention. The drawings show an ionizing probe 1 for spraying a sample, a heating chamber 11 for heating the sample, and a mass spectrometer 24. In this embodiment, an ESI mode (FIG. 1) and an APCI mode (FIG. 2) are present, and the configuration of the ion source differs in each mode. Thus, mode switching for switching the ionization method is performed. Mode switching is performed by moving two parts that are the ionization probe 1 and the heating chamber 11 relative to each other, and can be automatically performed by computer control.

The structure of the ionization probe 1 will be described. The ionization probe 1 has a structure in which three cylindrical nozzles are coaxially overlaid. The three cylindrical nozzles include a sample spray nozzle 2 for feeding a sample 5, a nebulizer gas nozzle 3 for flowing nebulizer gas 6, and a heating gas nozzle 4 for flowing heating gas 7. A sample or gas is flowed through the inside of each nozzle. The sample 5 is a solvent such as an organic solvent (i.e., methanol or acetonitrile) or water, or a liquid sample diluted with a mixed solvent of such solvents. A liquid sample is fed by a pump, and is fed at a flow rate in the range of about several nL/min to several mL/min. The sample spray nozzle 2 is a capillary made of metal, for example, and has an inner diameter of about several μm to several hundred μm. Not only a metal capillary, but also a glass capillary can be used. The nebulizer gas 6 has the effect of nebulizing a sample solution and spraying it in the form of a liquid mist, and the sample 5 is sprayed from an outlet end 8 of the ionization probe 1 by the nebulizer gas. The heating gas 7 promotes vaporization of a sample solution and thus promotes generation of ions, thereby contributing to improving sensitivity. The flow rate of each gas is set in the range of about zero to tens of L/min. The ionization probe 1 is connected to a driving portion 33 with a support portion 34, and can thus be moved by the driving portion 33. As an example of the support portion 34 and the driving portion 33, a driving stage that is movable in a single direction can be used. The ionization probe 1 moves in the long-axis direction of the ionization probe 1 (i.e., in the vertical direction in the drawing) in the ESI mode and the APCI mode as shown in FIGS. 1 and 2. The sample spray nozzle 2 is connected to a high-voltage power supply 9 so that a high voltage is applied to the sample spray nozzle 2.

The heating chamber 11 has a function of heating a sample for APCI and thus promoting vaporization. The outer shape of the heating chamber 11 is cylindrical, and the inside thereof has a cavity with a hole so as to pass a sprayed sample therethrough. For the heating chamber 11, a material with high thermal conductivity, such as metal or ceramic, is used. The heating chamber has a heater attached to the inside thereof, and thus can be controlled to a given temperature (e.g., hundreds of ° C.). The heating chamber 11 is connected to a driving portion 31 with a support portion 32, and thus can be moved by the driving portion 31. The heating chamber 11 also moves in the long-axis direction of the ionization probe 1 (i.e., in the vertical direction in the drawing) like the ionization probe 1. Further, a discharging electrode 12, which is supported by a support portion 13, is attached to the heating chamber 11, and the discharging electrode 12 moves in conjunction with the heating chamber 11. Accordingly, the heating chamber 11 and the discharging electrode 12 can be concurrently moved by a single driving portion. The discharging electrode 12 is connected to a high-voltage power supply 10. When a high voltage is applied to the discharging electrode 12, the discharging electrode 12 discharges electricity with an electrode at an inlet port 25 of the mass spectrometer. Thus, ionization becomes possible. The outer shape of the discharging electrode 12 may be, other than a cylindrical shape, any shape, such as a square pole, for example.

Sample ions that have been generated enter the mass spectrometer 24 from the inlet port 25, and are subjected to mass spectroscopy, so that a mass spectrum of m/z (mass-to-charge ratio) and the amount of ions is obtained.

The configurations and features of the ESI mode and the APCI mode, and a method for switching between the ionization methods will be described. The ionization method is switched when the ionization probe 1 and the heating chamber 11 are moved by the driving portions 31 and 33 and the configuration is thus changed. The driving portions 31 and 33 can move the ionization probe 1 and the heating chamber 11 via the support portions 32 and 34. For each of the driving portions and the support portions, a stage that is movable in a uniaxial direction, for example, is used. Movement of the stage may be either performed manually or automatically controlled by a computer.

Mode switching from the APCI mode to the ESI mode occurs when the heating chamber 11 has moved down to a level below the inlet port 25 of the mass spectrometer 24, and the ionization probe 1 has also moved down to a level at which the outlet end 8 of the ionization probe 1 is located around the inlet port 25. In the ESI mode, the sample 5 is heated and vaporized using the heating gas 7. Thus, the outlet end 8 of the ionization probe 1 is arranged around the inlet port 25 of the mass spectrometer 24 as shown in FIG. 1. Accordingly, sample ions sprayed from the outlet end 8 of the ionization probe can be efficiently introduced into the mass spectrometer 24.

In addition, in the ESI mode, the heating chamber 11 is moved to and arranged at a position where ionization of ESI is not disturbed, below and outside an ESI ionization region 21, which is located in proximity to the outlet end 8 of the ionization probe 1, so as to prevent a sample or sample ions from passing through the heating chamber 11. If bumping (i.e., boiling) of a sample solution occurs, problems occur in that electrospray becomes unstable, sensitivity decreases, and signal intensity becomes unstable. If the heating chamber 11 is placed away from the ionization probe 1, it is possible to, even when the heating chamber 11 is at a high temperature, stably spray a sample solution electrostatically without heating the sample spray nozzle 2 of the ionization probe 1 or bumping a liquid sample that comes out of the outlet end 8. A high voltage is applied to the sample spray nozzle 2 from the high-voltage power supply 9, so that a sample that has been electrostatically sprayed into the ESI ionization region 21 from the sample spray nozzle 2 at the outlet end 8 of the ionization probe 1 is ionized.

In the APCI mode, the heating chamber 11 is used while being heated to a high temperature so as to promote vaporization of a sample. Thus, the heating chamber 11 is also desirably heated and maintained at a high temperature in the ESI mode. This is because if the temperature settings are changed each time the ionization mode is switched, it takes a long time until the temperature becomes stable. That is, a waiting time of about several minutes for stabilizing the temperature is generated each time the ionization mode is switched. Consequently, the measurement stops and the measurement throughput decreases.

It is also possible to heat the ESI ionization region 21 using the heating chamber 11 at a high temperature during ESI. Due to radiant heat from the heating chamber 11, a heating region at a temperature higher than the room temperature is generated around the heating chamber 11. In particular, as a heating region 27 on the ionization probe side allows efficient vaporization of a sprayed sample, it is expected that ionization in the ionization region 21 is promoted. Adjustment of the temperature of the ionization region 21 is possible by changing the position of the heating chamber 11, that is, by placing the heating chamber 11 closer to or farther from the ionization region 21.

A method for setting the temperature of the heating chamber 11 constant (not changing the temperature) regardless of the ionization modes has been described above. As another method, it is also possible to lower the temperature of the heating chamber down to a level, which does not require much time to change the temperature, in the ESI mode. For example, it is possible to use a method of setting the temperature of the heating chamber at 600° C. in the APCI mode and lowering the temperature to 400° C. in the ESI mode. Consequently, it becomes possible to suppress power consumption of the heater of the heating chamber, and thus prevent unwanted propagation of heat to a sample or the periphery in the ESI mode.

Next, the configuration and the feature of the APCI mode will be described. Mode switching from the ESI mode to the APCI mode occurs when the ionization probe 1 has moved upward in the drawing and the heating chamber 11 has also moved upward in the drawing. In the APCI mode, as shown in FIG. 2, the heating chamber 11 is inserted between the ionization probe 1 and the inlet port 25, and the outlet end 8 of the ionization probe 1 and an inlet end 15 of the heating chamber 11 are arranged in proximity to or in contact with each other. An outlet end 35 of the heating chamber or the discharging electrode 12 is arranged around the inlet port 25 of the mass spectrometer 24.

A liquid sample is sprayed from the outlet end 8 of the ionization probe 1, and passes through a sample flow path 17 from the inlet end 15 of the heating chamber, and then moves toward an APCI ionization region 22 from the outlet end 35 of the heating chamber. The heating chamber 11 is maintained at a high temperature of hundreds of ° C. by a ceramic heater or the like that is attached to the heating chamber. Thus, heating and vaporization occur in the heating region 23 and the sample flow path 17 at a high-temperature state. The sample that has been vaporized and turned into gas is ionized in the APCI ionization region 22 by ions that are generated by corona discharge between the discharging electrode 12 and the electrode at the inlet port of the mass spectrometer 24. The thus ionized sample ions enter the mass spectrometer 24 from the inlet port 25 as in ESI, and are subjected to a mass analysis.

During APCI, a high voltage is desirably not applied to the sample spray nozzle 2 from the high-voltage power supply 9. This is because if a high voltage is applied, APCI ionization may be disturbed, which can result in a decrease in the amount of ions. Even if no voltage is applied, a sample is sprayed by the nebulizer gas 6.

In the APCI mode, the heating chamber 11 approaches closest to the ionization probe 1. FIG. 2 shows, as a desired configuration, a configuration in which the ionization probe 1 and the heating chamber are located spatially away from each other without contact. In such a case, it is possible to prevent heat of the heating chamber 11 at a high temperature from being transmitted to the ionization probe. Providing a heat-insulated structure by isolating the two components as described above is advantageous in that the temperature of each of the ionization probe and the heating chamber can be easily managed and controlled.

As another desired configuration, it is also possible to use a configuration in which a substance with low thermal conductivity is interposed between the ionization probe 1 and the heating chamber 11 so that the two components are physically contacted and bound together. When the two components are bound together, it is possible to match the position relationship of the ionization probe 1 and the heating chamber 11 with respect to each other with high reproducibility.

If a structure in which the ionization probe 1 (in particular, the heating gas nozzle 4) is allowed to be heated to a high temperature is used, it is possible to place the ionization probe 1 and the heating chamber 11 into direct contact with each other. That is, if a structure is used in which heat of the heating gas nozzle 4 is not transmitted to the sample spray nozzle 2 in the ionization probe 1, and a sample solution is thus not boiled, that is, if a structure is used in which the sample spray nozzle 2 is maintained at a temperature of about less than or equal to 50° C. even if the heating gas nozzle 4 is at a high temperature, it is possible to place the ionization probe 1 and the heating chamber 11 into direct contact with each other.

The method of the ion source in this embodiment has the following features and advantages.

First of all, as the ionization probe and the heating chamber are configured to be movable separately, it is possible to perform ionization with an optimal configuration in each of the ESI ionization mode and the APCI ionization mode, and thus realize high-sensitivity measurement.

Second, as the ionization probe and the heating chamber are provided in a separable configuration, the temperature of the heating chamber can be always maintained high. Consequently, as the temperature needed not be switched, it is not necessary to take time to switch the temperature. Thus, it is possible to switch the ionization mode at fast speed (in less than or equal to 10 seconds), and thus perform a high-throughput analysis. In the ESI mode, it is possible to prevent the sample spray nozzle 2 of the ionization probe from reaching a high temperature by placing the heating chamber 11 at a high temperature away from the ionization probe 1, and thus prevent bumping (or boiling) of a sample solution. Thus, stable measurement is also possible in the ESI mode.

Third, as the inner diameter of the sample flow path 17 in the heating chamber 11 can be reduced regardless of the size of the ionization probe, high vaporization efficiency can be realized in APCI. This is because the heating chamber moves in a direction away from the ionization probe unlike in Patent Literature 4 and thus the inner diameter of the flow path in the heating chamber can be designed in any configuration such that it is smaller than the outer diameter of the ionization probe, specifically, smaller than the outer diameter of the heating gas nozzle of the ionization probe (though it is impossible in Patent Literature 4). The vaporization efficiency of a sample is expected to improve more as the inner diameter of the heating chamber is smaller. This is because when the inner diameter is smaller, it becomes easier to transmit heat in the heating chamber to a sample solution that passes through the narrow flow path. Thus, vaporization easily occurs.

An exemplary sequence of switching an analysis and an ionization method will be described with reference to FIGS. 3 and 4. The abscissa axis represents time, and a time sequence of switching an ionization method and analyses based on two ionization modes is shown. "Switching" herein means switching between two ionization methods. In the example shown herein, "switching" is a process of changing the mode from the ESI mode to the APCI mode or changing the mode from the APCI mode to the ESI mode. An "analysis" herein is the time of performing a mass analysis by subjecting an injected sample to LC separation once, or a single flow injection analysis (FIA). The analysis time is about several minutes to 1 hour if LC separation is used, or about several minutes if FIA is used. The ionization mode can be switched in about several seconds to tens of seconds that are required for the driving portion to move the ionization probe and the heating chamber.

Figure 3:
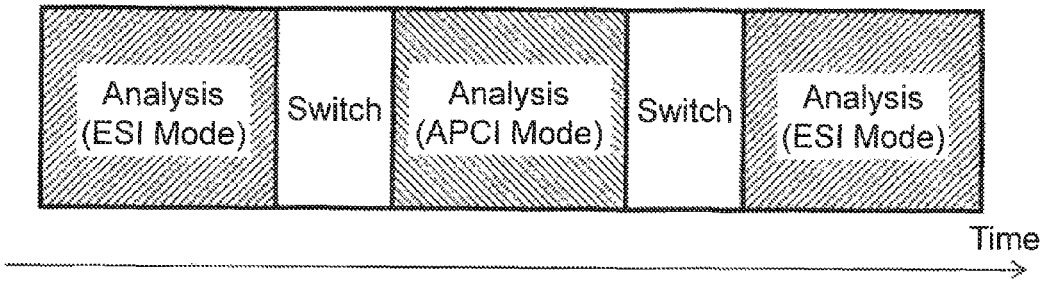
FIG. 3 is a time chart showing exemplary switching of an analysis and an ionization method.

The ionization modes include the ESI mode and the APCI mode as shown in FIG. 3. A switching time is generated when the ionization mode is switched. When the ionization mode is switched, the heating chamber 11 is moved, and further, the sample liquid feed rate, the flow rate of the nebulizer gas, the flow rate of the heating gas, high voltage, and the like are changed, so that an analysis is performed under optimal analysis conditions for each ionization mode. About 10 seconds are sufficient to change such voltage and gas flow rate.

Figure 4:
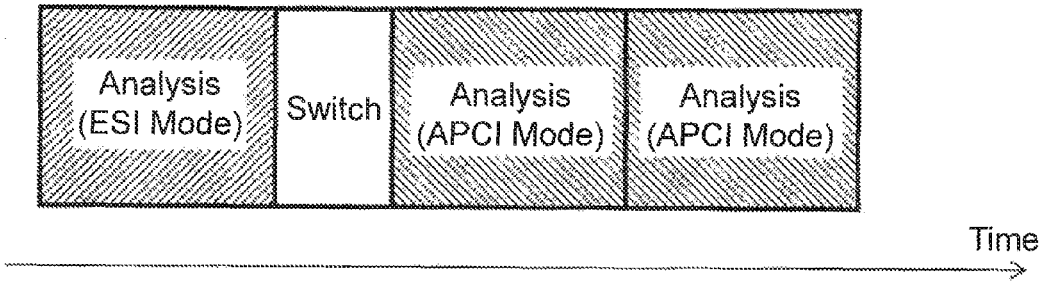
FIG. 4 is a time chart showing exemplary switching of an analysis and an ionization method.

As shown in FIG. 4, if analyses in the same ionization mode, for example, analyses in the APCI mode are consecutively performed, it is not necessary to switch the ionization mode. Thus, a switching time is not generated.

If the inlet end 15 of the heating chamber 11 has a funnel shape like a funnel portion 14 shown in FIG. 1, the heating gas 7, the nebulizer gas 6, and the sprayed sample 5 collect in and pass through the sample flow path 17 (i.e., inside the cylinder) in the heating chamber 11 in the APCI mode. Accordingly, as the sample flow path 17 is heated by the heat of the heating gas 7 and the heat of the heating chamber 11, high vaporization efficiency of the sample is expected.

As the mass spectrometer, an ion trap mass spectrometer such as a three-dimensional ion trap mass spectrometer or a linear ion trap mass spectrometer; a quadrupole mass spectrometer (Q Filter); a triple quadrupole mass spectrometer; time of flight mass spectrometer (TOF/MS); Fourier transform ion cyclotron resonance mass spectrometer (FTICR); an orbitrap mass spectrometer); a magnetic sector mass spectrometer; or the like is used. Besides, other known mass spectrometers may also be used.

As described above, according to this embodiment, the ionization mode is switched by the movement of the ionization probe 1 and the heating chamber 11. In the APCI mode, the ionization probe and the heating chamber are placed in proximity to or in contact with (i.e., bound to) each other, while in the ESI mode, the ionization probe and the heating chamber are placed away from each other. Such a method can provide an optimal configuration for each ionization method and thus can perform highly efficient ionization. Thus, a high-sensitivity analysis is realized. Further, as the temperature of the heating chamber can be maintained high, it is not necessary to take time to switch the temperature. Thus, the ionization method can be switched at fast speed.

Next, the second example of the first embodiment will be described. In this embodiment, the heating chamber is not in the shape of a funnel but in the shape of a cylinder with a single inner diameter or a cylinder with two or more different inner diameters. Points other than that are the same as those in the first example of the first embodiment.

Figure 5:
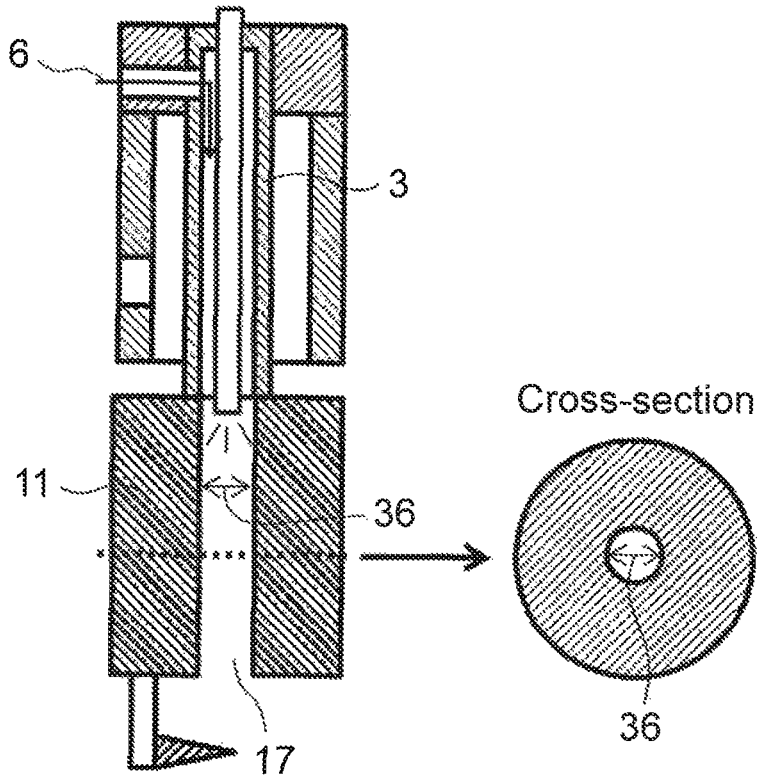
FIG. 5 is a schematic cross-sectional view showing an exemplary structure of a heating chamber.

FIG. 5 is a schematic cross-sectional view showing an embodiment of a configuration in which the sample flow path 17 in the heating chamber 11 has a cylinder with a single inner diameter 36. In FIG. 5, the arrangement in the APCI mode is shown. In the configuration in this example, a narrow portion with the small inner diameter 36 of the sample flow path 17 in the heating chamber is long. Thus, as heat in the heating chamber can be easily transmitted to a sample in the sample flow path 17, vaporization efficiency is expected to improve. There is another advantage in that the structure of the heating chamber is simple. The inner diameter 36 of the heating chamber 11 is about the same as the inner diameter of the nebulizer gas nozzle 3, and a sample sprayed by the nebulizer gas 6 can be heated and vaporized in the sample flow path 17 by the heating chamber 11. In this configuration, heating gas is not used in the APCI mode, but is used only in the ESI mode.

Figure 6:
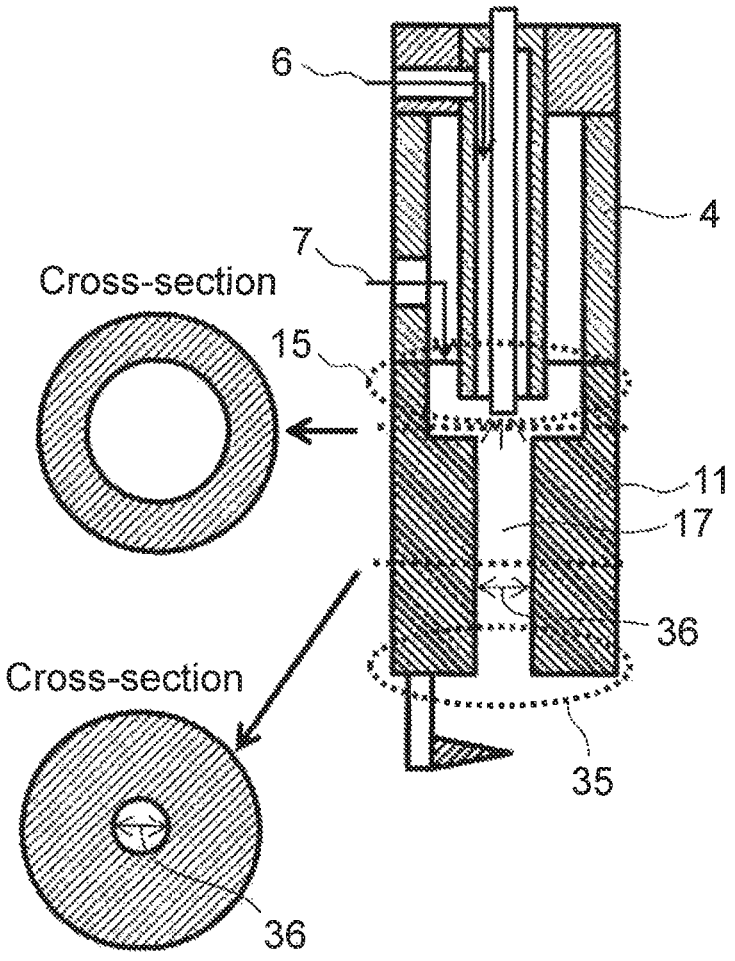
FIG. 6 is a schematic cross-sectional view showing an exemplary structure of a heating chamber.

FIG. 6 is a schematic cross-sectional view showing an embodiment of a configuration in which the sample flow path 17 in the heating chamber 11 has two cylinders with different inner diameters 36. In FIG. 6, the arrangement in the APCI mode is shown. The inner diameter of the inlet end 15 of the heating chamber is large and is about the same as the heating gas nozzle 4. Meanwhile, the inner diameter of the outlet end 35 is small. In the configuration in this example, the heating gas 7 can be flowed through the sample flow path 17 in the heating chamber 11 together with a sample sprayed by the nebulizer gas 6. Thus, vaporization efficiency in the heating chamber 11 is expected to improve.

The third example of the first embodiment will be described. This embodiment is characterized in that the inner diameter of the outlet end 35 of the heating chamber 11 is further reduced so that the vaporization efficiency of a sample further improves in APCI. Points other than that are the same as those in the first example of the first embodiment.

Figure 7:
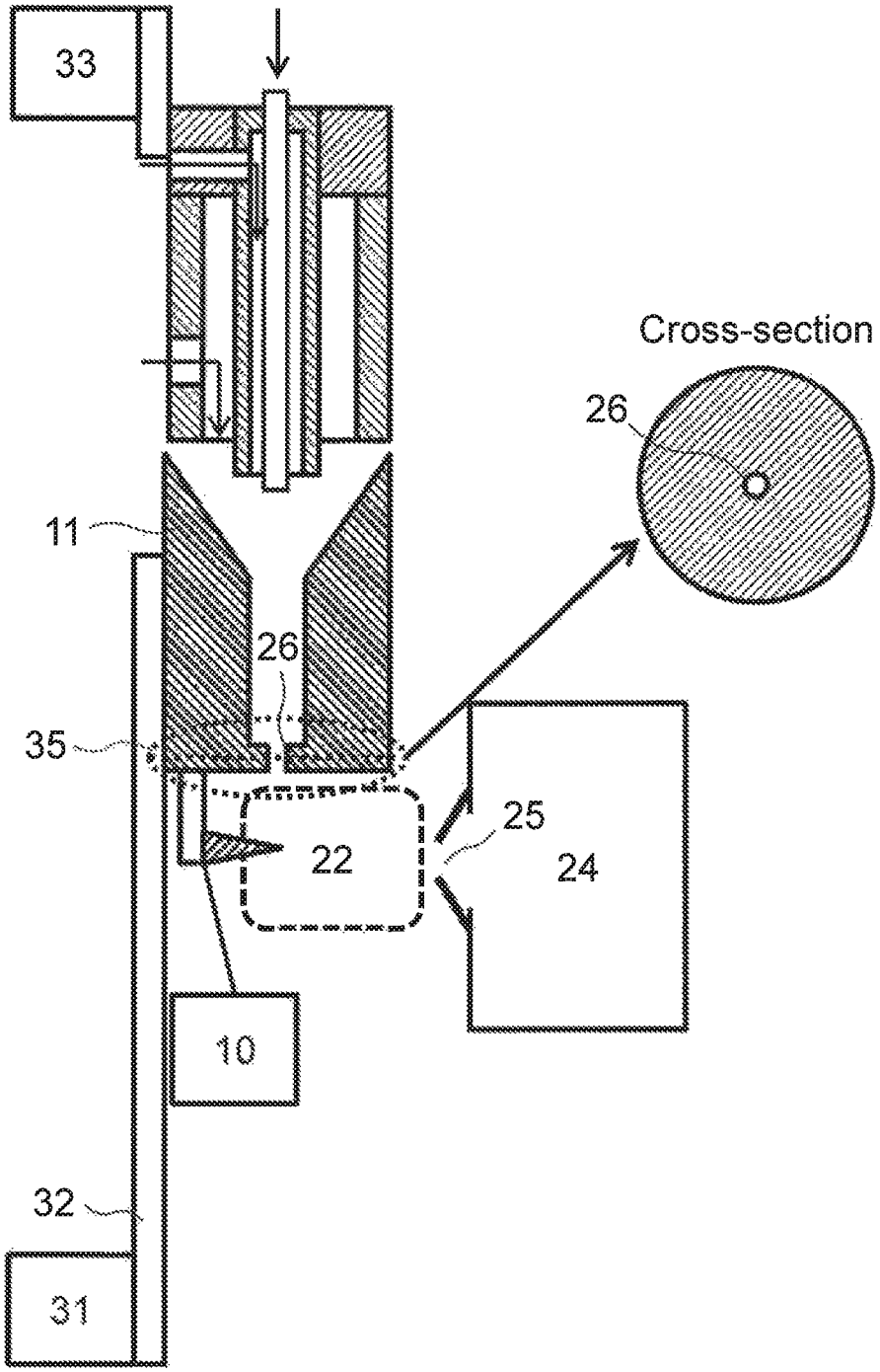
FIG. 7 is a schematic cross-sectional view showing an exemplary structure of a heating chamber.

FIG. 7 is a schematic cross-sectional view showing the APCI mode in the third example. Shown herein is a structure in which the outlet end 35 of the sample flow path 17 in the heating chamber 11 has a further narrower flow path 26, and thus has a smaller hole diameter. With a narrow diameter of the flow path 26, it becomes easier to, when a sprayed sample solution passes through the flow path 26, transmit heat in the heating chamber to the sample. Thus, the heating efficiency of the sample improves, and vaporization is promoted. Accordingly, sensitivity improves. The diameter of the hole of the flow path 26 is typically about 0.1 mm to several mm.

Figure 8:
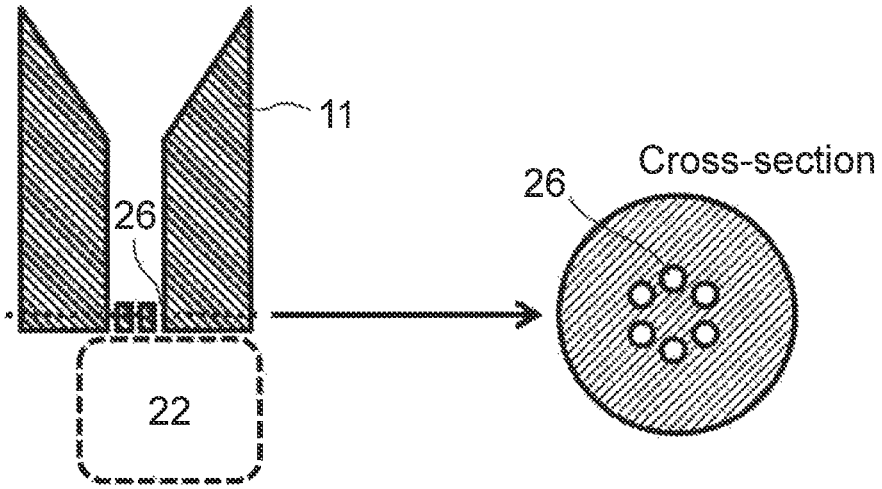
FIG. 8 is a schematic cross-sectional view showing an exemplary structure of a heating chamber.

FIG. 8 shows an exemplary structure of another heating chamber. A portion of the flow path 26 has a cylindrical structure with a plurality of holes (6 in the drawing). A sample passes through the 6 holes, and moves toward the APCI ionization region 22. The number of holes may be any number not less than 1. If the diameters of the holes are reduced in size, a sample that passes through the cylinder is made into proximity to the heating chamber. Thus, vaporization efficiency is expected to improve. Further, providing a plurality of holes can secure an amount of a sample that passes through the holes.

Figure 9:
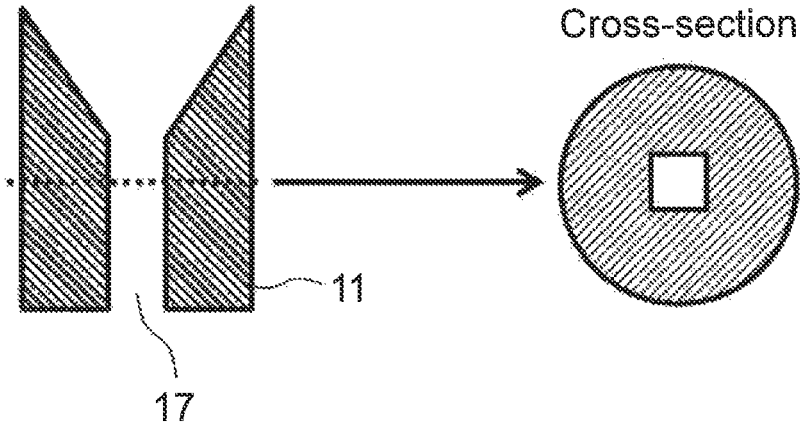
FIG. 9 is a schematic cross-sectional view showing an exemplary structure of a heating chamber.

FIG. 9 shows an exemplary structure of another heating chamber. In the examples shown above, the sample flow path 17 in the heating chamber 11 is cylindrical in shape. However, the sample flow path 17 may be in the shape of a square pole or other polygons as shown in FIG. 9. The structure of the sample flow path 17 is not limited to a column or a cylinder.

Figure 10:
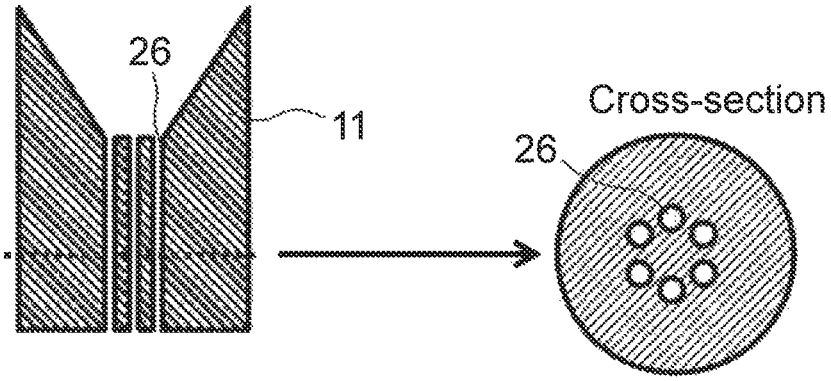
FIG. 10 is a schematic cross-sectional view showing an exemplary structure of a heating chamber.
Figure 11:
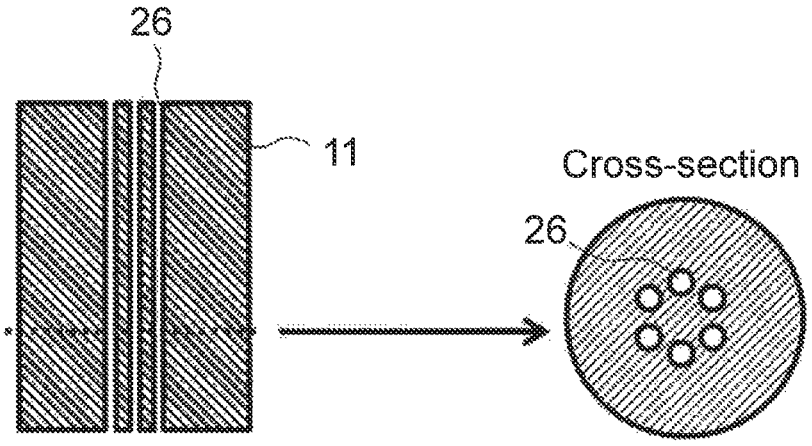
FIG. 11 is a schematic cross-sectional view showing an exemplary structure of a heating chamber.

FIG. 10 shows an exemplary structure of another heating chamber. Although FIG. 8 shows an example in which only the outlet end of the sample flow path is in the shape of a plurality of cylinders, the sample flow path may be in the shape of a plurality of cylinders across the entire heating chamber as shown in FIG. 10. Alternatively, as shown in FIG. 11, a structure without a funnel portion is also possible.

The fourth example of the first embodiment will be described. In this embodiment, a method of flowing heating gas 16 to the ESI ionization region 21 using the heating chamber 11 in ESI will be described. The other configurations and methods are the same as those in the first example.

Figure 12:
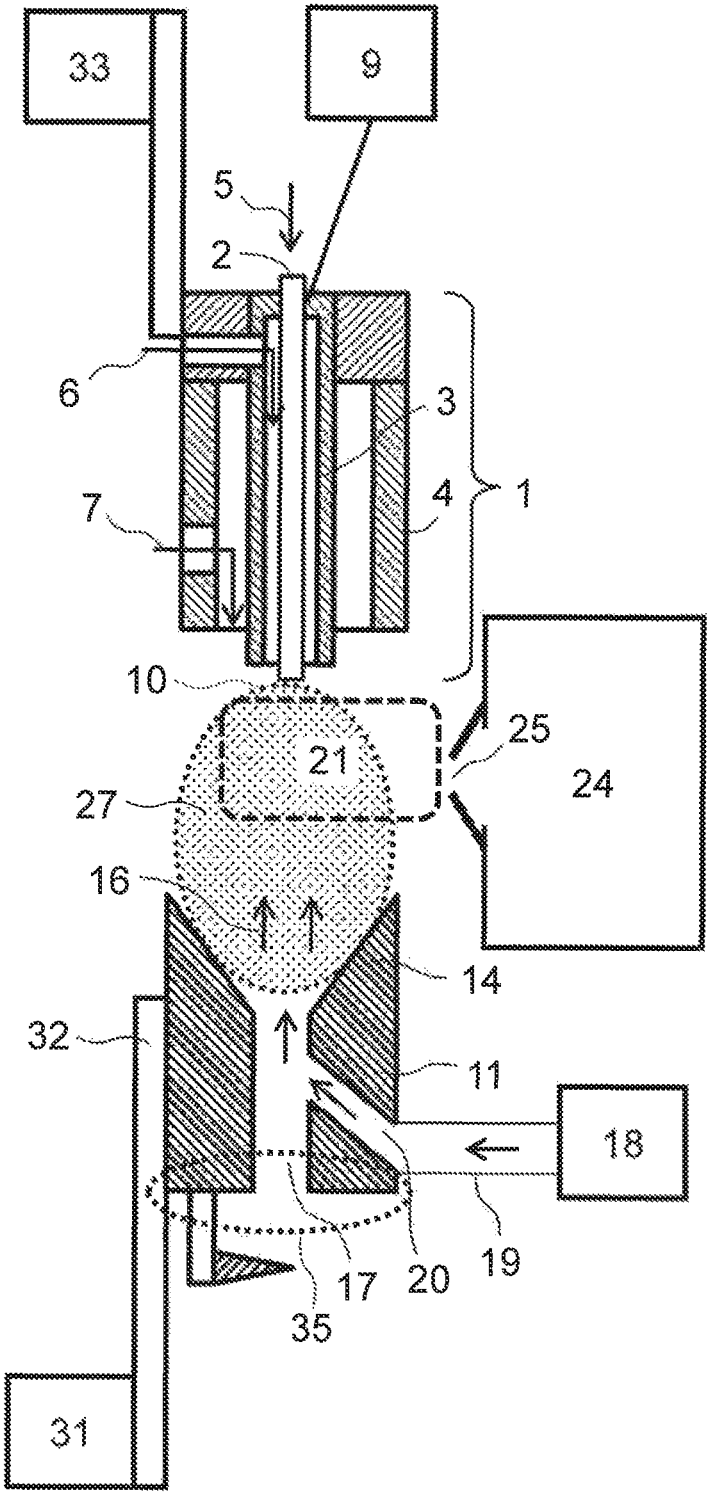
FIG. 12 is a schematic cross-sectional view showing an exemplary structure of a heating chamber.

FIG. 12 is a schematic cross-sectional view showing an exemplary configuration in the ESI mode. In the ESI mode, a gas flow rate control unit 18 is attached to the heating chamber 11, and gas is introduced into a gas flow path 20 through a gas pipe 19. Gas is heated in advance, or is heated during passage through the flow path in the heating chamber 11. The heated heating gas 16 flows in the direction of the ESI ionization region 21 from the funnel portion 14 at the upper end of the heating chamber 11. Nitrogen or air is used for the gas. The heating gas 16, by heating the heating region 27, also heats a region around the ESI ionization region 21, and promotes vaporization and desolvation of a sample in electrospray, thus contributing to improving sensitivity. The gas flow path 20 is preferably in a cylindrical shape with as a narrow inner diameter as possible because such a structure allows heat in the heating chamber 11 to be transmitted to gas more easily, and thus increases the temperature of the gas to a high temperature more efficiently. Further, as a sample moves toward the outlet end 35 from the funnel portion 14 in the APCI mode, there is a possibility that a part of the sample may become mixed in the gas flow path 20. Thus, the gas flow path 20 is desirably formed as small a hole as possible. In addition, if a small amount of gas is also flowed by the gas flow rate control unit 18 in the APCI mode, it is possible to prevent mixing of a part of a sprayed sample or solvent into the gas flow rate control unit 18 from the gas flow path 20. As another method, a method of physically closing the gas flow path 20 using metal, ceramic, or the like in the APCI mode is also effective.

In addition, as shown in FIG. 12, the gas flow path 20 is desirably opened obliquely in the direction of the ESI ionization region 21. Accordingly, the heating gas 16 can be efficiently introduced in the direction of the ESI ionization region 21 (i.e., upward).

Figure 13:
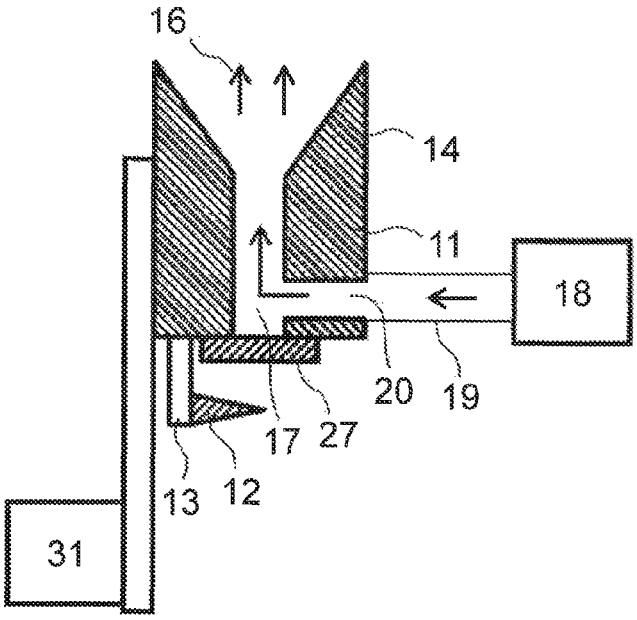
FIG. 13 is a schematic cross-sectional view showing an exemplary structure of a heating chamber.

FIG. 13 is a schematic cross-sectional view showing another exemplary configuration of the heating chamber 11. In this configuration, a cap 27 is provided at the outlet end of the sample flow path 17 in the heating chamber 11. If the cap 27 is provided, gas that is introduced from the gas flow rate control unit 18 in the ESI mode can turn at a junction with the sample flow path 17 toward the funnel portion 14, and thus can flow toward the ESI ionization region 21. Thus, efficient desolvation becomes possible with the heating gas 16. Meanwhile, in APCI, the cap 27 is removed, so that a sample that has entered from the sample flow path 17 can pass through the sample flow path 17, move toward the discharging electrode 12 downward, and thus be ionized. The cap 27 may be automatically opened or closed when the ionization mode is switched. The existing technology, such as a driving stage, can be used for opening or closing the cap 27. Further, in the APCI mode, if a small amount of gas is flowed by the gas flow rate control unit 18, it is possible to prevent mixing of a part of a sprayed sample or a solvent into the gas flow rate control unit 18 from the gas flow path 20.

Figure 14:
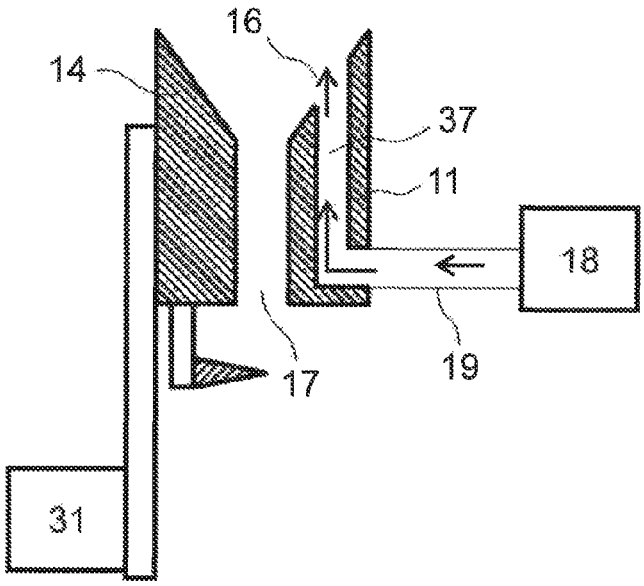
FIG. 14 is a schematic cross-sectional view showing an exemplary structure of a heating chamber.

FIG. 14 shows another exemplary configuration of the heating chamber 11. In the ESI mode, gas, which has been introduced from the gas flow rate control unit 18, passes through a gas flow path 37, comes out of an outlet in the funnel portion 14, and flows toward the ESI ionization region 21 as the heating gas 16. The gas flows through the gas flow path 37 that is a different flow path than the sample flow path 17 through which a sample passes in the APCI mode. Meanwhile, in the APCI mode, if a small amount of gas is flowed by the gas flow rate control unit 18, it is possible to prevent mixing of a part of a sprayed sample or a solvent into the gas flow rate control unit 18 from the gas flow path 20.

Figure 15:
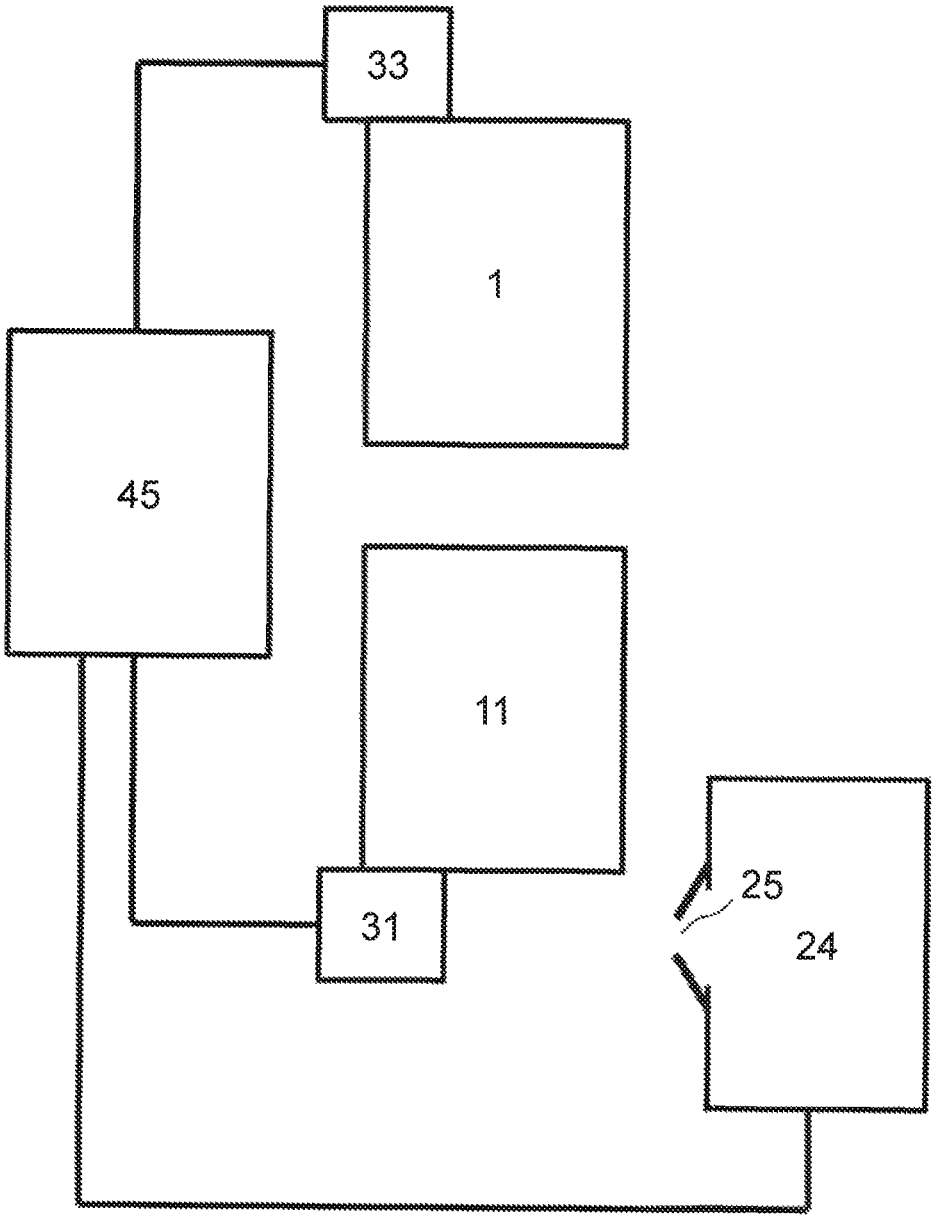
FIG. 15 is a block diagram showing an exemplary system configuration.

FIG. 15 is a block diagram showing an exemplary system configuration of the first embodiment. The driving portions 31 and 33 that drive the ionization probe 1 and the heating chamber 11 are controlled by a controller 45 such as a PC. Instructions (i.e., moving time (i.e., timing) and moving distance) designated by a user in advance are stored in the controller 45. The ionization probe 1 and the heating chamber 11 move when the driving portions 31 and 33 are driven in response to instructions from the controller 45. In addition, the mass spectrometer can also be controlled by the controller 45. As described above, the ion source and the mass spectrometer are controlled by the controller 45.

Second Embodiment

The second embodiment is an embodiment in which the moving direction of the heating chamber differs. In this embodiment, the movement direction of the heating chamber is not a linear movement along a single, straight line, but a rotational movement about a fixed point. The method for moving the ionization probe is the same as that in the first embodiment.

Figure 16:
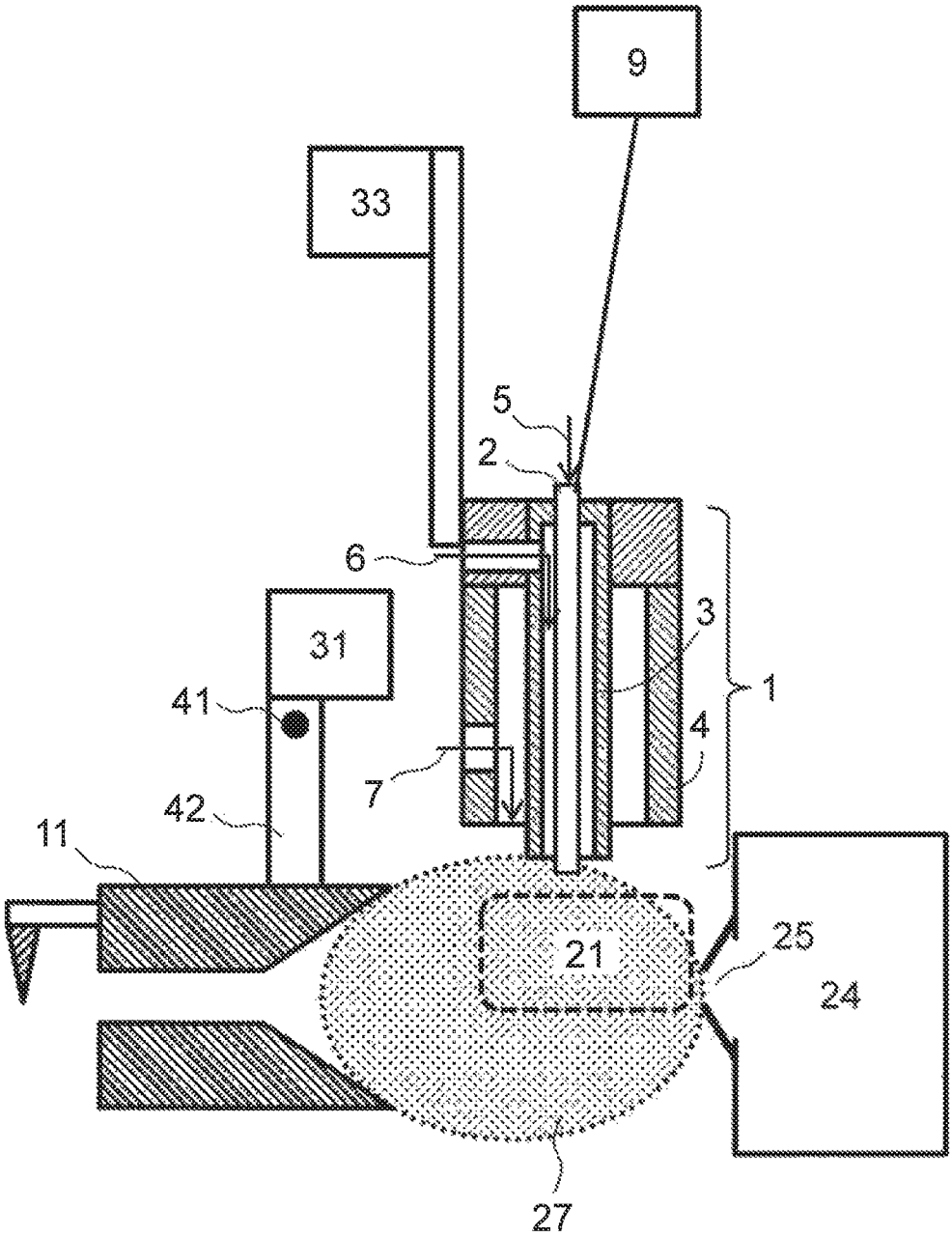
FIG. 16 is a schematic cross-sectional view showing an exemplary configuration (ESI mode) of an ion source in the second embodiment.
Figure 17:
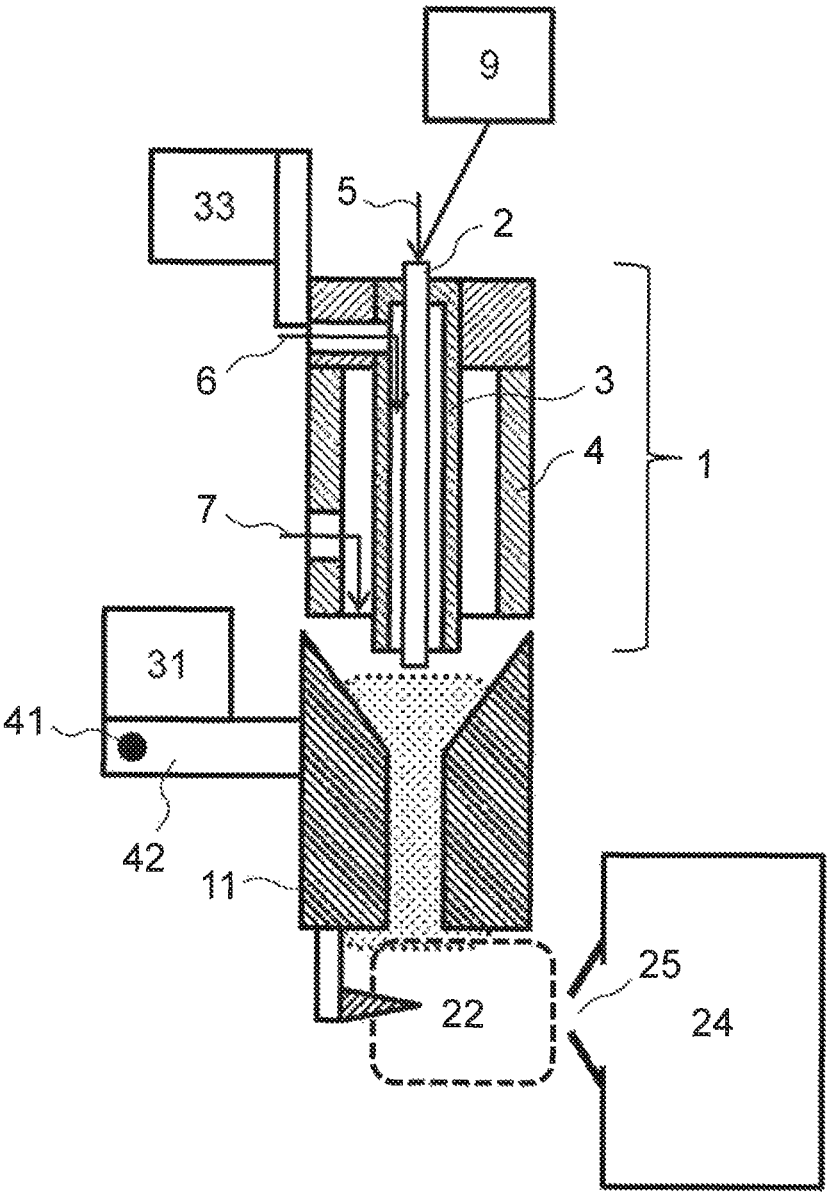
FIG. 17 is a schematic cross-sectional view showing an exemplary configuration (APCI mode) of an ion source in the second embodiment.

FIGS. 16 and 17 are schematic cross-sectional views each showing this embodiment. FIG. 16 shows the ESI mode, and FIG. 17 shows the APCI mode. As the configuration of and the method for moving the ionization probe 1 are the same as those in the first embodiment, the detailed description thereof will be omitted. Thus, hereinafter, the operation of the heating chamber 11 will be described.

The heating chamber 11 is connected to the driving portion 31 with a support portion 42, and moves by rotating about a fixed point 41. In the ESI mode, the heating chamber 11 is moved away from the ionization probe 1, and is placed at a position opposite (in front of) the mass spectrometer 24 (FIG. 16). At the same time, the ionization probe 1 moves downward so that the outlet end 8 of the sample spray nozzle 2 is in proximity to the inlet port 25 of the mass spectrometer 24. The ionization probe 1 is moved using the driving portion 33 as in Embodiment 1. In the ESI mode, the heating chamber 11 is also heated by a heater. Thus, a region around the heating chamber 11 is heated, and a heating region 27 is heated on the mass spectrometer 24 side. Accordingly, as desolvation and vaporization of a sprayed sample are promoted in the ionization region 21, ionization efficiency is also expected to improve in the ESI mode.

Meanwhile, in the APCI mode, the heating chamber 11 is rotated about the fixed point 41 by 90 degrees by the driving portion 31, and moves such that the heating chamber 11 comes into proximity to or contact with the ionization probe 1 as shown in FIG. 17. At this time, the ionization probe 1 moves upward. In the APCI mode, the APCI ionization region 22 of the heating chamber 11 is set such that it is positioned ahead of the inlet port 25 of the mass spectrometer 24 by the support portion 42 and the driving portion 31.

In this embodiment, the heating chamber 11 is not located along an extension of the sample spray nozzle 2 in the ESI mode. Thus, as a sprayed sample does not easily stick to the heating chamber 11, there is an advantage in that the heating chamber 11 does not become dirty with the sprayed sample. Therefore, as dirt (contamination) of the ion source and detection of contaminants (i.e., carry over) can be prevented, measurement with higher precision is expected to be achieved.

Third Embodiment

The third embodiment will be described. In this embodiment, the overall length of the heating chamber (i.e., length in the vertical direction in the drawing) is reduced to eliminate the need to move the ionization probe 1 when switching the mode and thus allow switching of the ionization method only by the movement of the heating chamber 11.

Figure 18:
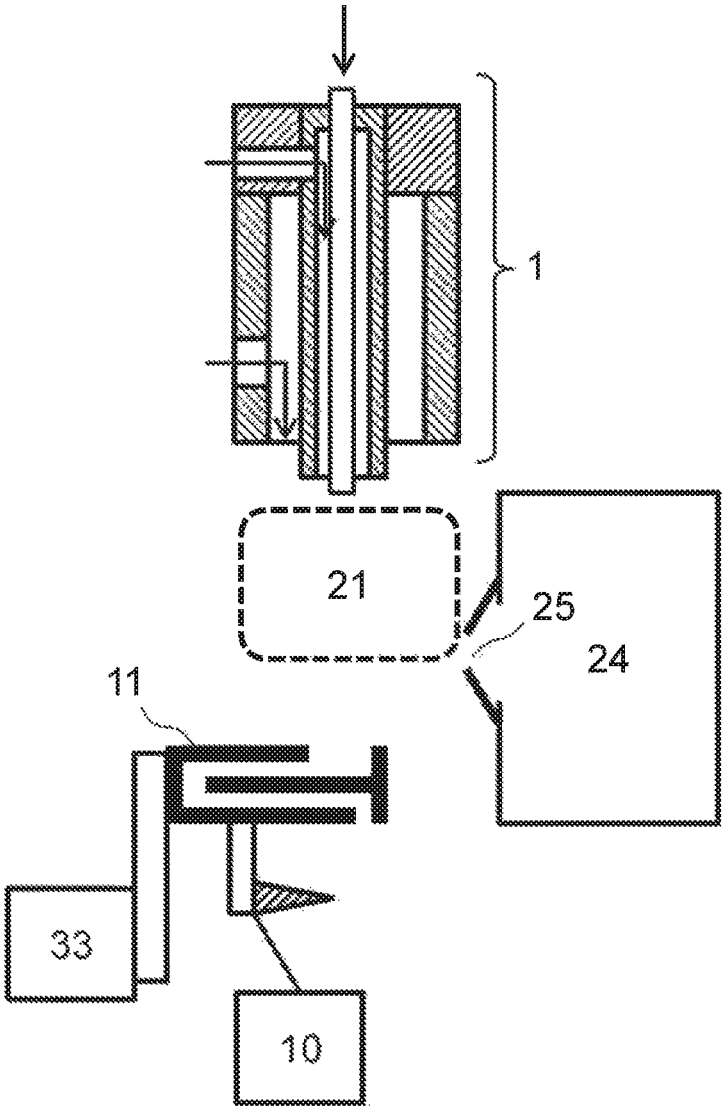
FIG. 18 is a schematic cross-sectional view showing an exemplary configuration (ESI mode) of an ion source in the third embodiment.
Figure 19:
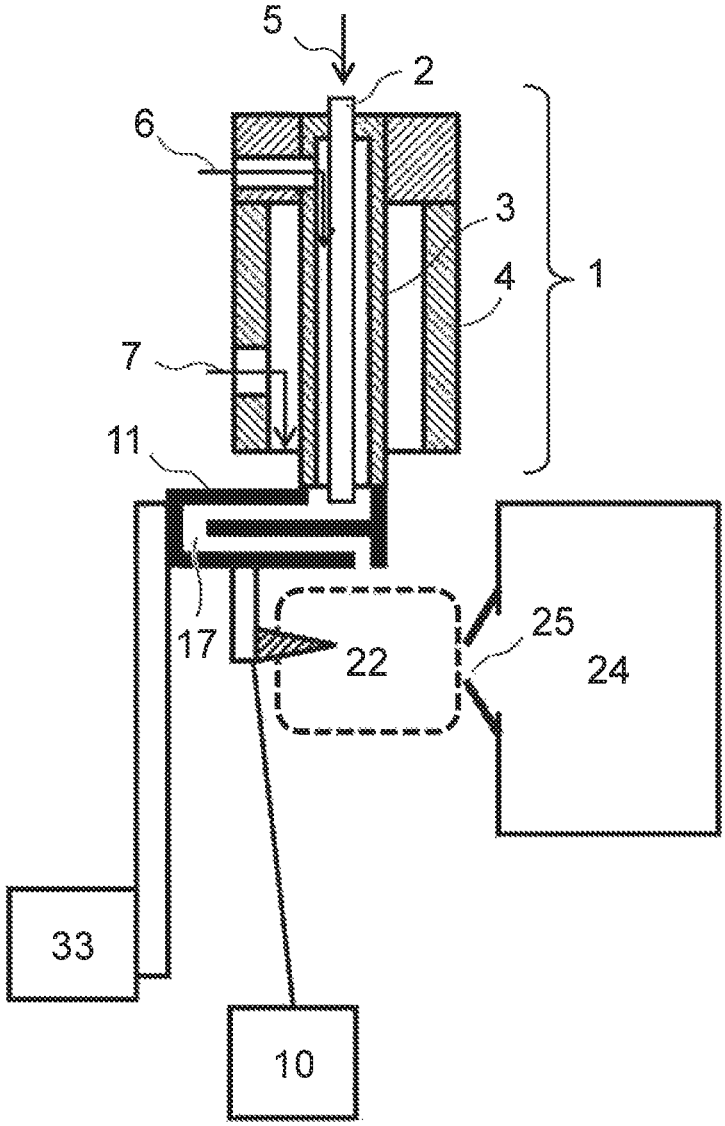
FIG. 19 is a schematic cross-sectional view showing an exemplary configuration (APCI mode) of an ion source in the third embodiment.

FIGS. 18 and 19 show the arrangement in the ESI mode and the APCI mode. FIG. 18 shows the arrangement in the ESI mode, and FIG. 19 shows the arrangement of the APCI mode. This embodiment differs from the aforementioned embodiments only in the shape of the heating chamber 11. It should be noted that in the example shown in the drawing, the heating chamber 11 moves in the vertical direction in the drawing using the driving portion 33 as in the first embodiment. However, it is also possible to move the heating chamber 11 by rotating it about a fixed point as in the second embodiment. Although the ionization probe 1 is also moved when the ionization method is switched in the aforementioned embodiments, the ionization probe 1 need not be moved in this embodiment.

As shown in FIG. 18, the position of the ionization probe 1 is fixed so that the ESI ionization region 21 is positioned ahead of the inlet port 25 of the mass spectrometer 24 in the ESI mode. When switching the mode to the APCI mode as shown in FIG. 19, it is possible to position the APCI ionization region 22 at a place ahead of the inlet port 25 of the mass spectrometer 24 by moving the heating chamber 11 to a position below the ionization probe 1. Such arrangement is enabled by the heating chamber 11 with a short overall length (i.e., length in the vertical direction in the drawing).

As a feature of this embodiment, the ionization probe 1 may be fixed without being moved as the heating chamber 11 in the vertical direction is short. Consequently, as the heating chamber 11 has only to be moved when ionization is switched, there is an advantage in that only one driving portion is necessary.

As the second feature, as the heating chamber 11 in the vertical direction is short, the pipe is arranged in a serpentine manner to secure the distance of the heating region. If the heating chamber 11 has a straight cylindrical pipe structure as in the aforementioned embodiments, the distance of the heating region cannot be secured. Thus, it is necessary to form a structure with which the heating distance and time can be secured. As an example, the sample flow path in the heating chamber 11 is arranged in a serpentine manner to secure the time and distance for heating sample gas.

Fourth Embodiment

The fourth embodiment will be described. In this embodiment, a method for moving the heating chamber differs. When the mode is switched from the APCI mode to the ESI mode, a method for moving the heating chamber that is different than the aforementioned methods is used. Specifically, in this embodiment, the heating chamber is divided into two parts, and the two parts move in opposite directions to each other.

Figure 20:
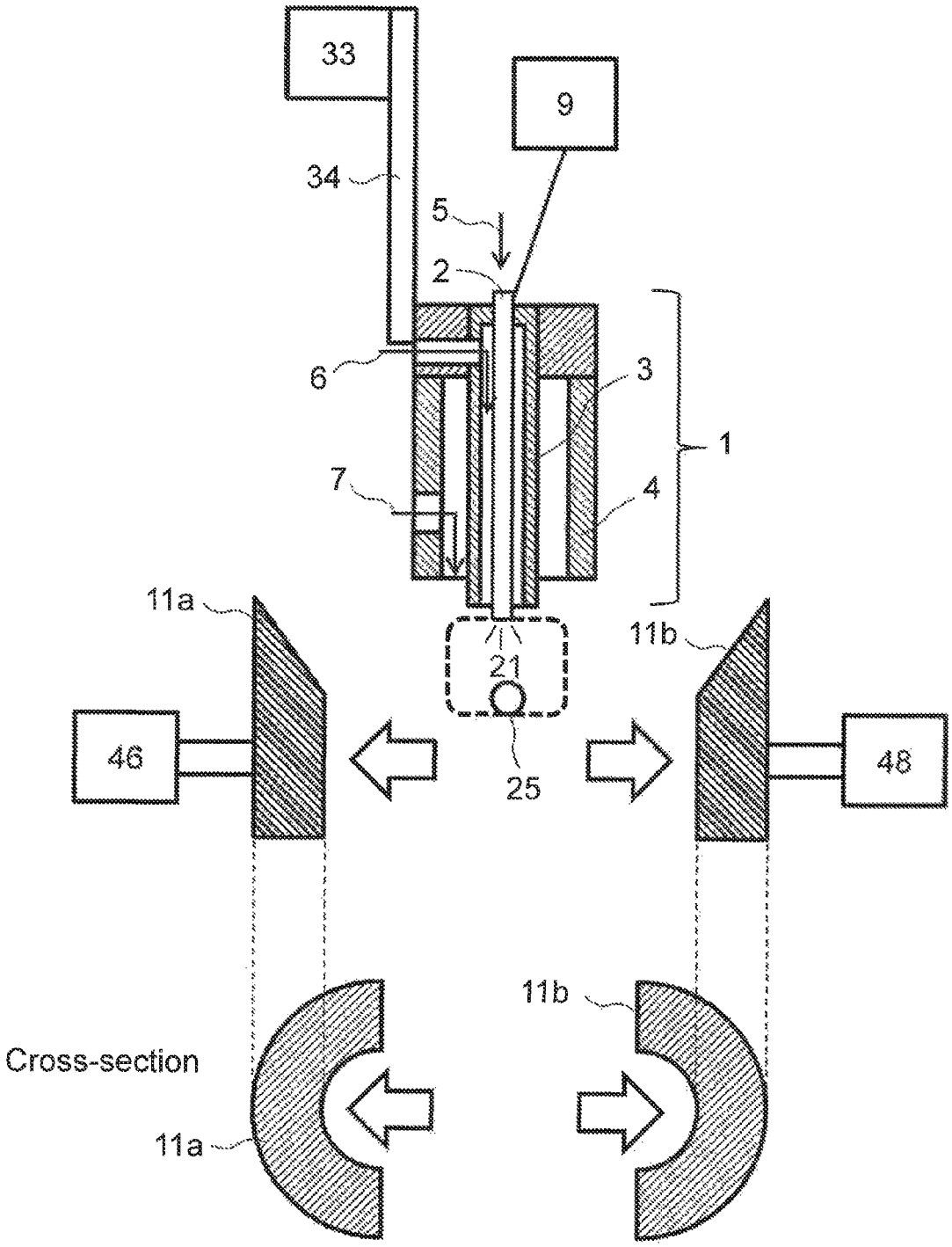
FIG. 20 is a schematic cross-sectional view showing an exemplary configuration (ESI mode) of an ion source in the fourth embodiment.

FIG. 20 is a schematic cross-sectional view showing an exemplary configuration in the ESI mode. FIG. 20 is a view in which the inlet port 25 of the mass spectrometer 24 is seen from the front side unlike the drawings shown heretofore. The heating chamber is divided into two parts 11*a* and 11*b* as shown in the drawing that are moved away from each other in a plane that is perpendicular to the axis of ion introduction of the inlet port 25 of the mass spectrometer 24. As described above, in the ESI mode, the heating chamber is moved away from the ionization probe 1 so that the ionization probe 1 can be prevented from being heated. The two parts 11*a* and 11*b* of the heating chamber are connected to driving portions 46 and 48 via support portions 47 and 49, respectively, and are driven by the driving portions 46 and 48. The other points, such as the ionization method, are the same as those in Embodiment 1. In order to maintain the temperature of the heating chamber having two parts 11*a* and 11*b* high, heaters are desirably attached to the two respective separate parts 11*a* and 11*b* of the heating chamber for heating purposes.

In this embodiment, a region around the ESI ionization region 21 may also be heated by the two parts 11*a* and 11*b* of the heating chamber in the ESI mode. Either the heating method that uses radiant heat from the heating chamber or the method that uses heating gas described in Embodiment 1 can be used. Accordingly, vaporization of ions is promoted, and sensitivity is thus expected to improve.

In the APCI mode, the two separate parts 11*a* and 11*b* of the heating chamber are combined together to form a heating chamber. The configuration in the APCI mode is the same as that in FIG. 2.

Fifth Embodiment

As the ionization method, APPI (atmospheric pressure photoionization) may also be used instead of APCI. APPI can be implemented by arranging a vacuum ultraviolet lamp instead of a discharging electrode. Besides, any ionization methods that can convert gas into ions can be used instead of APCI.

Figure 21:
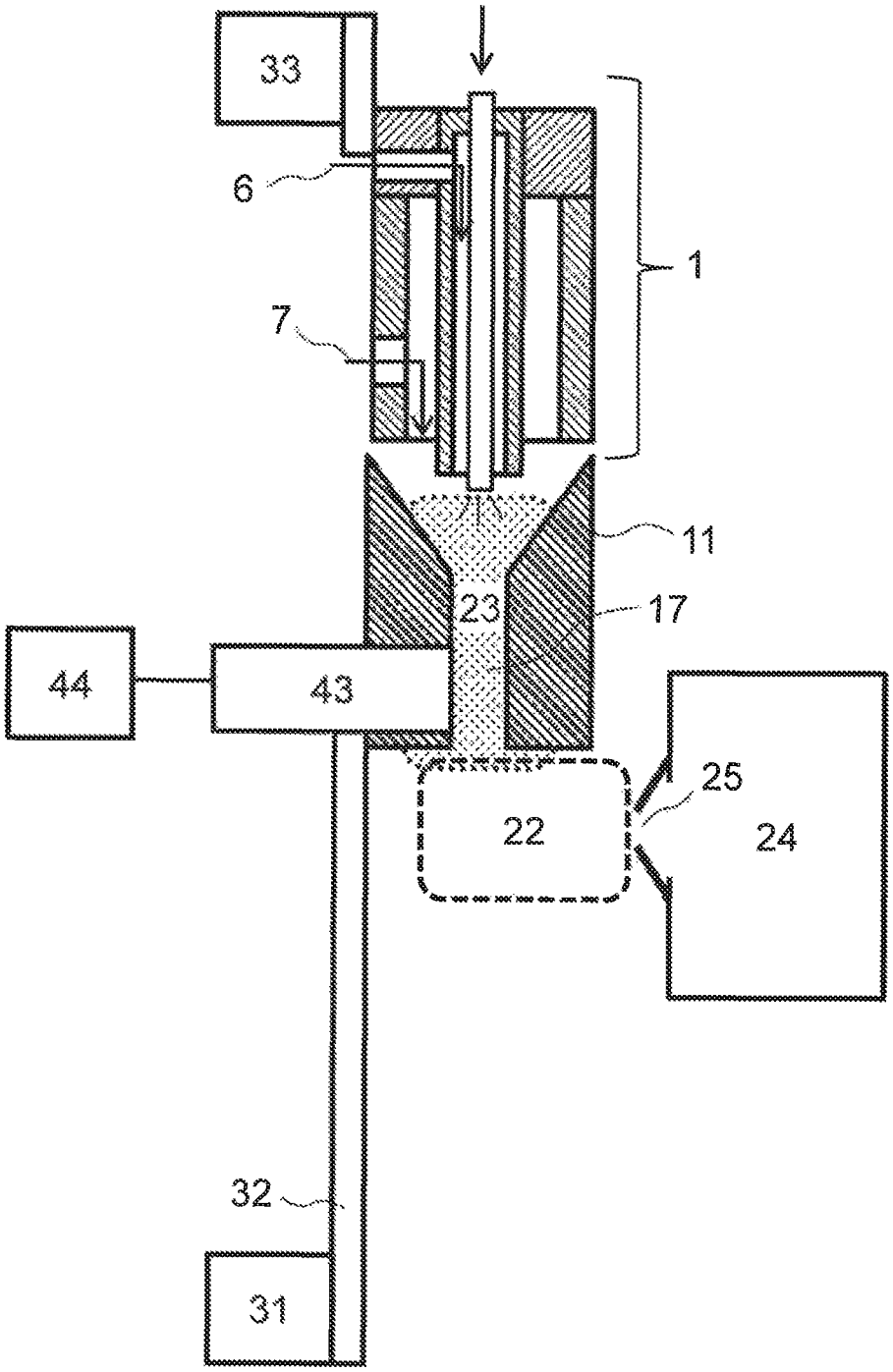
FIG. 21 is a schematic cross-sectional view showing an exemplary configuration (APPI mode) of an ion source in the fifth embodiment.

FIG. 21 is a schematic cross-sectional view showing an embodiment that uses APPI. Unlike the configuration in the APCI mode shown in FIG. 2, an ultraviolet lamp 43 and a power supply 44 for the lamp are provided instead of the discharging electrode 12 as well as the support portion 13 and the high-voltage power supply 10 for the discharging electrode 12 used in APCI. The ultraviolet lamp 43 is attached to the heating chamber 11, and moves together with the heating chamber 11. The ultraviolet lamp 43 irradiates the sample flow path 17 in the heating chamber with light to effect ionization. The lamp is turned on or off using the power supply 44. Controlling the power supply 44 using the control unit 45 shown in FIG. 15 can also automatically control on/off of the ultraviolet lamp 43. The other points, such as a method for moving the ionization probe 1 and the heating chamber 11 are the same as those in Embodiment 1.

Besides, any ionization methods that need heating and vaporization of a sample can be used instead of APCI or APPI.

In the ESI mode, it is also possible to use an ionization method that is similar to ESI. For example, SSI (sonic spray ionization) can be used.

It should be noted that the present invention is not limited to the aforementioned embodiments, and includes a variety of variations. For example, although the aforementioned embodiments have been described in detail to clearly illustrate the present invention, the present invention need not include all of the configurations described in the embodiments. It is possible to replace a part of a configuration of an embodiment with a configuration of another embodiment. In addition, it is also possible to add, to a configuration of an embodiment, a configuration of another embodiment. Further, it is also possible to, for a part of a configuration of each embodiment, add/remove/substitute a configuration of another embodiment.

REFERENCE SIGNS LIST

1 Ionization probe
2 Sample spray nozzle
3 Nebulizer gas nozzle
4 Heating gas nozzle
5 Sample
6 Nebulizer gas
7 Heating gas
8 Outlet end of ionization probe
9 High-voltage power supply
10 High-voltage power supply
11 Heating chamber
12 Discharging electrode
13 Support portion
14 Funnel portion
15 Inlet end of heating chamber
16 Heating gas
17 Sample flow path
18 Gas flow path control unit
19 Gas pipe
20 Gas flow path
21 ESI ionization region
22 APCI ionization region
23 Heating region
24 Mass spectrometer
25 Inlet port
26 Flow path
27 Heating region
31 Driving portion
32 Support portion
33 Driving portion
34 Support portion
35 Outlet end of heating chamber
36 Inner diameter
37 Gas flow path
41 Fixed point
42 Support portion
43 Ultraviolet lamp
44 Power supply for lamp
45 Control unit
46 Driving portion
47 Support portion
48 Driving portion
49 Support portion

The invention claimed is:

1. An ion source comprising:

an ionization probe for spraying a sample;

a heating chamber having an internal sample flow path, the heating chamber being adapted to heat and vaporize a sample that flows through the sample flow path; and a driving portion for changing a distance between an outlet end of the ionization probe and an inlet end of the heating chamber, wherein the distance between the ionization probe and the heating chamber is changed by the driving portion to individually execute a plurality of ionization methods, such that the ionization probe and the heating chamber are spaced apart from each other in at least one ionization method, and an inner diameter of the sample flow path in the heating chamber is smaller than an outer diameter of a heating gas nozzle of the ionization probe.

2. The ion source according to claim 1, wherein the plurality of ionization methods include ESI and APCI or include ESI and APPI.

3. The ion source according to claim 2, wherein in the ESI mode, an ESI ionization region that is formed around the outlet end of the ionization probe is heated by heat of the heating chamber.

4. The ion source according to claim 1, wherein the inlet end of the heating chamber is in the shape of a funnel, and a central portion and an outlet end of the heating chamber are in the shape of a cylinder.

5. The ion source according to claim 1, wherein the sample flow path in the heating chamber includes one or more cylinders.

6. The ion source according to claim 1, wherein the sample flow path in the heating chamber has a plurality of flow paths connected together, the plurality of flow paths having different inner diameters.

7. The ion source according to claim 1, wherein at least one of the ionization probe or the heating chamber is driven linearly by the driving portion.

8. The ion source according to claim 1, wherein the heating chamber is moved by being rotated about a fixed point.

9. The ion source according to claim 1, wherein heating gas is sent from the heating chamber to an ionization region that is formed around the outlet end of the ionization probe.

10. The ion source according to claim 1, wherein an overall length of the heating chamber is short and the sample flow path is serpentine, and the ionization probe is fixed and the heating chamber is movable.

11. A mass spectrometric device comprising:

an ion source adapted to ionize a sample;

a mass spectrometer having an ion inlet port into which sample ions obtained through ionization by the ion source are introduced, the mass spectrometer being adapted to analyze a mass of the ions introduced from the ion inlet port; and a control unit, wherein the ion source includes an ionization probe for spraying a sample, a heating chamber having an internal sample flow path, the heating chamber being adapted to heat and vaporize a sample that flows through the sample flow path, and a driving portion for changing a distance between an outlet end of the ionization probe and an inlet end of the heating chamber, and the driving portion is controlled by the control unit to change a position relationship of the ionization probe and/or the heating chamber with respect to the ion inlet port of the mass spectrometer, thereby individually executing a plurality of ionization methods, the control unit is adapted to control the driving portion so that a sample ionization region of an ionization method that uses the ionization probe, and a sample ionization region of an ionization method that uses the ionization probe and the heating chamber are positioned near the ion inlet port of the mass spectrometer, and depending on an ionization method being executed, either the ion inlet port is arranged between the outlet end of the ionization probe and the inlet end of the heating chamber, or the outlet end of the ionization probe and the inlet end of the heating chamber are arranged adjacent to each other and the outlet end of the heating chamber is arranged adjacent to the inlet port of the mass spectrometer.

12. The mass spectrometric device according to claim 11, wherein the plurality of ionization methods include ESI and APCI or include ESI and APPI, and the control unit is adapted to, in the ESI mode, control the driving portion so that the heating chamber is not arranged between the outlet end of the ionization probe and the ion inlet port of the mass spectrometer, and to, in the APCI mode or the APPI mode, control the driving portion so that the heating chamber is arranged between the outlet end of the ionization probe and the ion inlet port of the mass spectrometer.

13. The ion source according to claim 11, wherein an inner diameter of the sample flow path in the heating chamber is smaller than an outer diameter of a heating gas nozzle of the ionization probe.

* * * * *